US005305520A

United States Patent [19]

Doorbar et al.

[11] Patent Number: 5,305,520

[45] Date of Patent: Apr. 26, 1994

[54] METHOD OF MAKING FIBRE REINFORCED METAL COMPONENT

[75] Inventors: Phillip J. Doorbar, Derby; Ian D. A. Sudds, Lancashire, both of Great Britain

[73] Assignee: Rolls-Royce plc, London, England

[21] Appl. No.: 45,429

[22] Filed: Apr. 13, 1993

Related U.S. Application Data

[63] Continuation-in-part of Ser. No. 739,519, Aug. 2, 1991, Pat. No. 5,222,296.

[30] Foreign Application Priority Data

Sep. 1, 1990 [GB] United Kingdom ..... 9019093

[51] Int. Cl.[5] ..... B23P 15/00

[52] U.S. Cl. ..... 29/889.21; 29/419.1; 29/889.22; 29/889.23; 228/194

[58] Field of Search ..... 29/889.21, 889.22, 889.23, 29/888.06, 419.1; 228/194

[56] References Cited

U.S. PATENT DOCUMENTS

| | | | |
|---|---|---|---|
| 3,296,886 | 1/1967 | Reinhart, Jr. . | |
| 4,570,316 | 2/1986 | Sakamaki et al. | 29/419.1 |
| 4,589,176 | 5/1986 | Resman et al. | 29/419.1 |
| 4,697,324 | 10/1987 | Grant et al. | 29/419.1 |
| 4,809,903 | 3/1989 | Eylon et al. | 228/194 |
| 4,867,644 | 9/1989 | Wright et al. . | |
| 4,907,736 | 3/1990 | Doble . | |
| 5,042,710 | 8/1991 | Surmm | 29/419.1 |

FOREIGN PATENT DOCUMENTS

| | | |
|---|---|---|
| 2157730 | 8/1973 | France . |
| 2078338 | 6/1982 | United Kingdom . |
| 2198675 | 11/1988 | United Kingdom . |
| WO9108893 | 6/1991 | World Int. Prop. O. . |

*Primary Examiner*—Irene Cuda
*Attorney, Agent, or Firm*—Cushman, Darby & Cushman

[57] ABSTRACT

A ceramic fibre reinforced metal rotor with integral rotor blades is manufactured using a continuous strip of unidirectional ceramic fibres in a metal matrix. The continuous strip of ceramic fibres in a metal matrix is cut into a plurality of separate pieces of predetermined length. The separate pieces of ceramic fibres in the metal matrix are arranged alternately in a spiral, with separate pieces of unreinforced metal matrix in adjacent abutting relationship to form a ring which has a plurality of laminations. The ring of laminations of metal matrix composite pieces and unreinforced metal matrix pieces are arranged between an inner and an outer metal ring to form an assembly. The assembly is consolidated by hot isostatic pressing using radially applied pressure. The separate pieces of metal matrix composite provide compliance to reduce breaking or buckling of the fibres, and the pieces of unreinforced metal matrix prevents damage spreading between laminations.

23 Claims, 4 Drawing Sheets

METHOD OF MAKING FIBRE REINFORCED METAL COMPONENT

This application is a continuation-in-part of application Ser. No. 07/739,519, filed Aug. 2, 1991, now U.S. Pat. No. 5,222,296.

BACKGROUND OF THE INVENTION

The present invention relates to a method of manufacturing fibre reinforced metal components, particularly fibre reinforced metal rings, cylinders and discs.

The ideal arrangement for a fibre reinforced metal ring, or disc, is to arrange the fibers circumferentially such that they extend continuously without breaks in a fully dense metal matrix. This is difficult to achieve because a certain amount of movement is required in practice to achieve good diffusion bonding, and density, between the layers of fibers. The fibers used to reinforce the metal matrix are ceramic, and ceramic fibers have very low extension to failure values, typically 1%. On consolidation using radial pressure from the inside surface of the ring the continuous ceramic fibers are placed under high tensile stress resulting in filament breakage and loss of structural integrity. On consolidation using redial pressure from the outer surface of the ring, the continuous ceramic fibers are buckled which reduces structural integrity. On consolidation using radial pressure from both the inside and outside surfaces of the ring, the continuous ceramic fibers either break under high tensile stress for the radially inner layers of ceramic fibers or buckle for the radially outer layers of ceramic fibers. This resulting fibre reinforced metal ring therefore contains many random fibre breaks and thus the fibre reinforced metal ring has unknown levels of mechanical properties.

In one known method of manufacturing a fibre reinforced metal ring, as disclosed in UK Patent Application No. GB216S032A, a filament is wound spirally in a plane with matrix material between the turns of the spiral. The spiral is positioned between discs of matrix mate rial, and is then pressed axially to consolidate the ring structure. This method produces little or no breaking of the fibers, however it is a laborious method.

In a further known method of manufacturing a fibre reinforced metal ring, as disclosed in UK Patent Application No. GB2078338A, a metal matrix tape, which has reinforcing fibers, is wound onto a mandrel and then inserted into a metal shaft. The fibers are arranged generally axially of the shaft. The assembly is pressed to consolidate the ring structure. This method does not have the ideal arrangement of fibers for a ring.

Another known method of manufacturing a fibre reinforced metal ring, as disclosed in UK patent Application No. GB2198675A, a continuous helical tape of fibers and a continuous helical tape of metal foil are interleaved. The interleaved helical tapes of fibers and metal foil are pressed axially to consolidate the assembly. This method produced little or no breaking of the fibers.

The present invention seeks to provide a novel method of manufacturing fibre reinforced metal components.

Accordingly the present invention provides a method of manufacturing a fibre reinforced metal component comprising arranging at least one separate piece of metal matrix composite and at least on e piece of unreinforced metal matrix alternately in adjacent abutting relationship to form at least one laminate, the at least one separate piece of metal matrix composite comprises a plurality of undirectionally arranged fibers in a metal matrix, the at least one separate piece of metal matrix composite being arranged such that the fibers embedded in the metal matrix extend in the same directional sense, arranging the at least one laminate of at least one metal matrix composite piece and at least one piece of unreinforced metal matrix between a first metal member and a second metal member to form an assembly, consolidating the assembly to bond the first metal member, the at least one laminate of at least one metal matrix composite and the at least one piece of metal matrix and the second metal member to form a unitary composite component.

Preferably a plurality of separate pieces of metal matrix composite and a plurality of pieces of unreinforced metal matrix are arranged to form at least one laminate.

Preferably the at least one separate piece of metal matrix composite and the at least one piece of unreinforced metal matrix are arranged in a ring, the first metal member and the second metal member are rings.

Preferably a plurality of separate pieces of metal matrix composite and a plurality of pieces of unreinforced metal matrix are arranged in a spiral to form a plurality of laminates.

Alternately a plurality of separate pieces of metal matrix composite and a plurality of pieces of unreinforced metal matrix are arranged in concentric rings to form a plurality of laminates.

The pieces of metal matrix composite may have equal lengths.

The second metal ring is preferably positioned radially outwardly of the at least one laminate of metal matrix composite.

At least one rotor blade may be welded onto the second metal ring by friction welding or electron beam welding.

Preferably the second metal ring is machined to form at least one rotor blade integral with the second metal ring.

Preferably the second metal member is electrochemically machined to form the at least one rotor blade.

The separate pieces of metal matrix composite and the pieces of unreinforced metal matrix may be secured to a continuous backing strip to allow the separate pieces of metal matrix composite and the pieces of unreinforced metal matrix to be wound into a spiral.

The backing strip may comprise unreinforced metal matrix.

Preferably the backing strip comprises a plastic or other suitable material which is subsequently removed.

The first metal member, the second metal member and the metal matrix composite may comprise titanium, titanium aluminide, an alloy of titanium or any suitable metal, alloy or intermetallic which is capable of being bonded.

The fibers may comprise silicon carbide, silicon nitride, boron, alumina or other suitable ceramic fibers.

Preferably the consolidating process comprises hot isostatic pressing.

The consolidating process may alternately comprise differential hot expansion of a first ring inside a suitable low expansion second ring.

The pieces of metal matrix composite and the pieces of metal matrix are preferably arranged on the inner surface of the second metal ring, the first metal ring is moved coaxially into the second metal ring.

The second metal ring preferably has a radially inwardly extending flange at one axial end to locate the pieces of metal matrix composite and the pieces of metal matrix axially.

The first metal ring preferably has a radially outwardly extending flange at one axial end to locate the pieces of metal matrix composite and the pieces of metal matrix axially.

BRIEF DESCRIPTION OF THE DRAWINGS

The present invention will be more fully described by way of example with reference to the accompanying drawings, in which:-

DETAILED DESCRIPTION OF THE INVENTION

Figure 1:
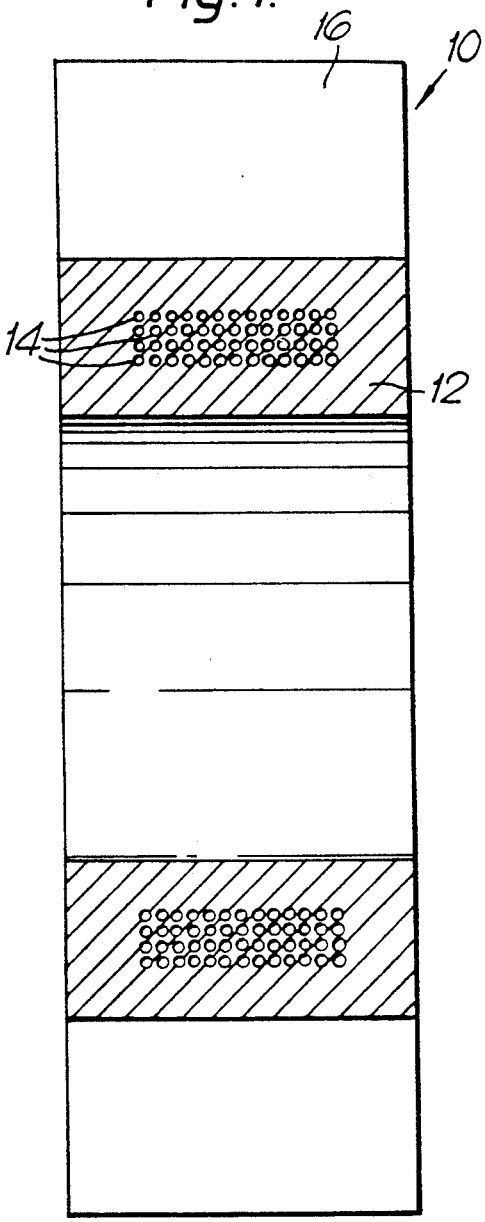
FIG. 1 is a longitudinal cross-sectional view through a bladed compressor rotor made according present invention.

A finished ceramic fibre reinforced metal rotor 10 with integral rotor blades is shown in FIG. 1. The rotor comprises a metal ring 12 which includes a ring of circumferentially extending reinforcing ceramic fibers 14, which are fully diffusion bonded into the metal ring 12. A plurality of solid metal rotor blades 16, extend radially outwardly from and, are integral with the metal ring 12.

The ceramic fibre reinforced metal rotor 10 is manufactured using a conventional continuous strip containing a monolayer of unidirectional ceramic fibers embedded in a metal matrix. The continuous strip of unidirectional ceramic fibers in the metal matrix or metal matrix composite strip, is cut into a number of separate pieces of metal matrix composite. Each of the separate pieces of metal matrix composite is cut to a predetermined length dependent upon the diameter of the rotor and for other reasons which will be mentioned herein.

Figure 2:
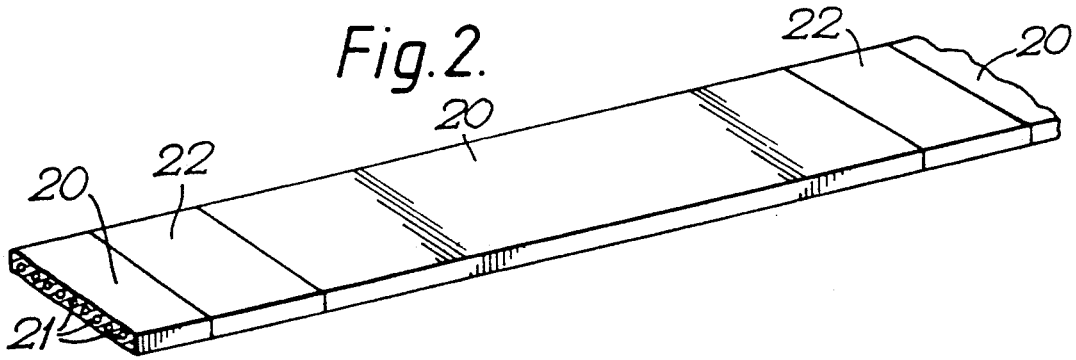
FIG. 2 is a perspective view of strips of unidirectional fibre reinforced metal matrix arranged alternately with inserts of unreinforced metal matrix.

The separate pieces of metal matrix composite 20 are preferably arranged alternately with separate pieces of unreinforced metal matrix 22 in adjacent abutting relationship, as shown in FIG. 2. The pieces of unreinforced metal matrix also have predetermined lengths. The separate pieces of metal matrix composite 20 are arranged such that the ceramic fibers 21 in adjacent pieces extend in the same direction. The pieces of metal matrix composite 20 and the pieces of unreinforced metal matrix 22 are arranged in a spiral to form a ring which has a plurality of laminations 26, as shown in FIGS. 3 and 4, in which all the fibers extend circumferentially.

The lengths of the pieces of metal matrix composite 20 and the lengths of the pieces of unreinforced metal matrix 22 are selected to suite the diameter of the rotor, such that there is an optimum distribution of the unreinforced metal matrix pieces throughout the completed rotor to obtain a uniform distribution of strength throughout the circumference of the rotor. The distribution of unreinforced metal matrix pieces is such that they are not radially adjacent each other in adjacent laminations.

Figure 3:
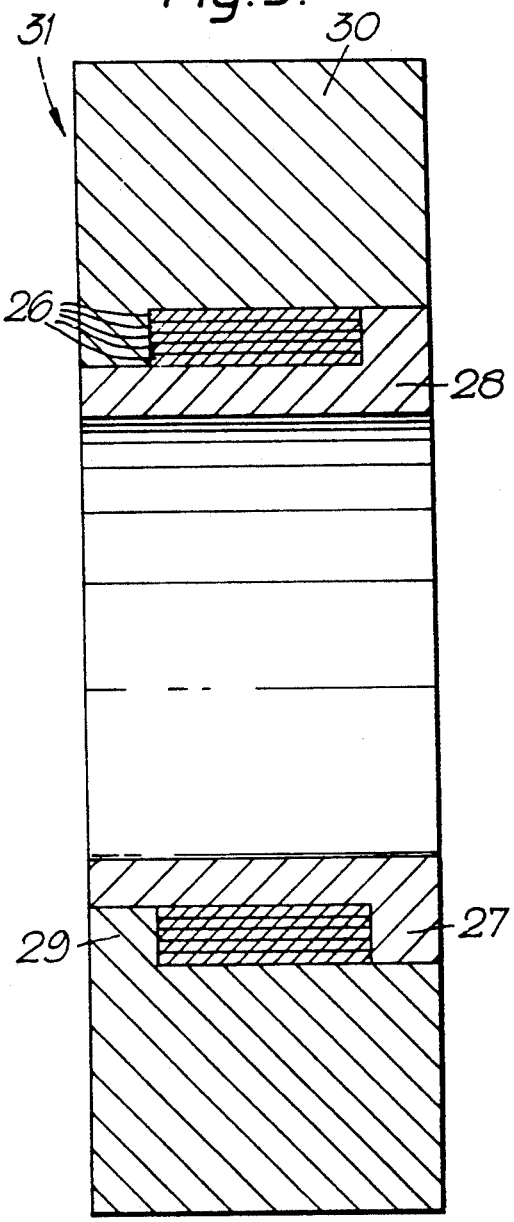
FIG. 3 is a longitudinal cross-sectional view through an assembly of strips of unidirectional fibre reinforced metal matrix and inserts of unreinforced metal matrix positioned between inner and outer metal rings.
Figure 4:
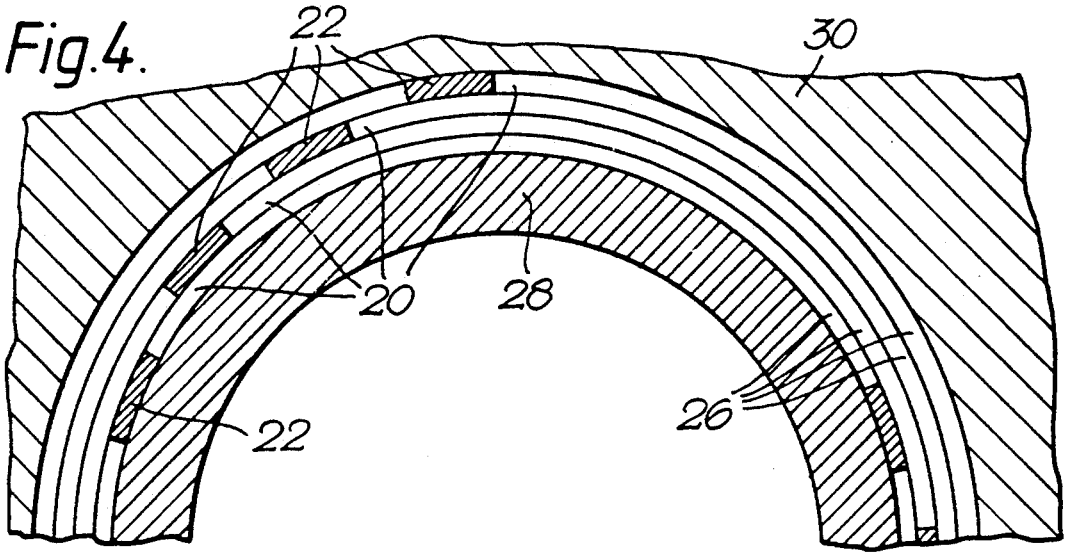
FIG. 4 is an enlarged transverse cross-sectional view through the assembly in FIG. 3.

The laminations 26 of metal matrix composite pieces and unreinforced metal matrix pieces are arranged between an inner metal ring 28 and an outer metal ring 30 to form an assembly 31 as shown in FIG. 3.

The pieces of metal matrix composite 20 and the pieces of unreinforced metal matrix 22 are arranged in a spiral by placing the pieces alternately adjacent each other in end to end relationship on the inner surface of the outer metal ring 30. The outer metal ring 30 has a radially inwardly extending flange 29 at one axial end which locates the pieces axially. When the pieces of metal matrix composite and pieces of unreinforced metal matrix have been arranged in laminations to the internal diameter of the flange 29, the inner metal ring 28 is pushed coaxially into the outer metal ring 30. The inner metal ring 28 has a radially outwardly extending flange 27 at one axial end which abuts the pieces at the opposite axial end to the flange 29 of the outer metal ring 30. The inner diameter of flange 29 is substantially the same as the outer diameter of the inner metal ring 28 and the outer diameter of flange 27 is substantially the same as the inner diameter of the outer metal ring 30.

The assembly 31 is placed in a vacuum chamber which is subsequently evacuated, the flange 27 of the inner ring 28 is welded to the outer ring 30 and the flange 29 of the outer ring 30 is welded to the inner ring 28. Electron beam welding or other suitable welding processes may be used.

The assembly 31 is then consolidated using heat and pressure to form a fibre reinforced metal ring. The vacuum chamber is heated so as to heat the assembly 31 and a pressurizing gas, for example argon, is introduced to apply pressure onto the assembly 31. The consolidation takes place using radial pressure on both the inside surface of the inner metal ring 28 and on the outside surface of the outer metal ring 30, and pressure is also applied on the axial surfaces of the rings. The application of heat and pressure to the assembly 31 is preferably by hot isostatic pressing.

The use of the plurality of separate pieces of metal matrix composite in the laminations provides the required degree of compliance in the assembly, to allow the ceramic fibers to move circumferentially without further breaking during the consolidation. The use of the plurality of separate pieces of unreinforced metal matrix between adjacent pieces of metal matrix composite allows the consolidation process to achieve full density and good diffusion bonding, and prevents fibers in a piece of metal matrix composite in an adjacent lamination becoming damaged due to the spreading of breakages. The incorporation of a piece of unreinforced metal matrix, i.e. a break in the ceramic fibers in a laminate is preferable to an area with several laminations each of which has broken ceramic fibers.

The outer metal ring 30 in FIG. 3 is much greater in radial dimension than the inner metal ring 28, so that after the assembly has been consolidated, the outer metal ring 30 is machined to produce a finished ceramic fibre reinforced metal rotor. The outer metal ring 30 may be machined to produce axially extending firtree, or dovetail, slots or may be machined to produce a circumferentially extending dovetail slot using conventional machining techniques to receive conventional compressor or turbine blades.

The outer metal ring 30 is much greater in radial dimension than the inner metal ring 28, so that after the assembly has been consolidated, the outer metal ring 30 may be machined, e.g. electrochemically machined, to produce the finished ceramic fibre reinforced metal rotor with integral blades as shown in FIG. 1. The outer metal ring 30 is more massive than the inner metal ring 28, and so the assembly is consolidated more in a radially outward direction.

Figure 5:
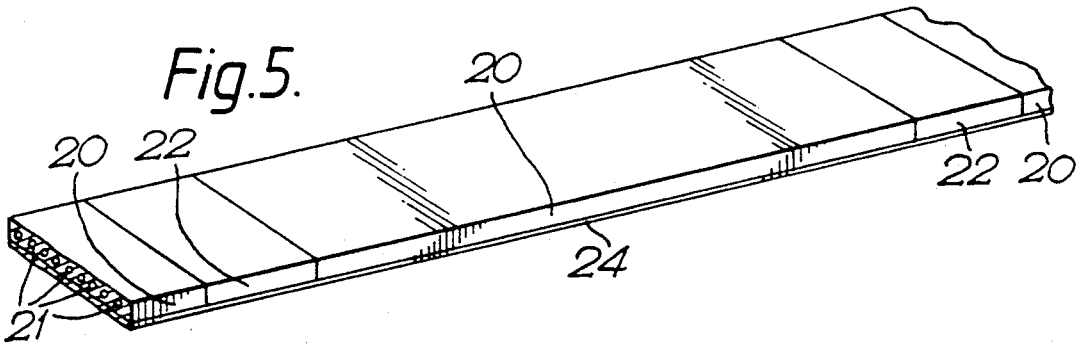
FIG. 5 is a perspective view of strips of unidirectional fibre reinforced metal matrix arranged alternately with inserts of unreinforced metal matrix on a backing strip.
Figure 6:
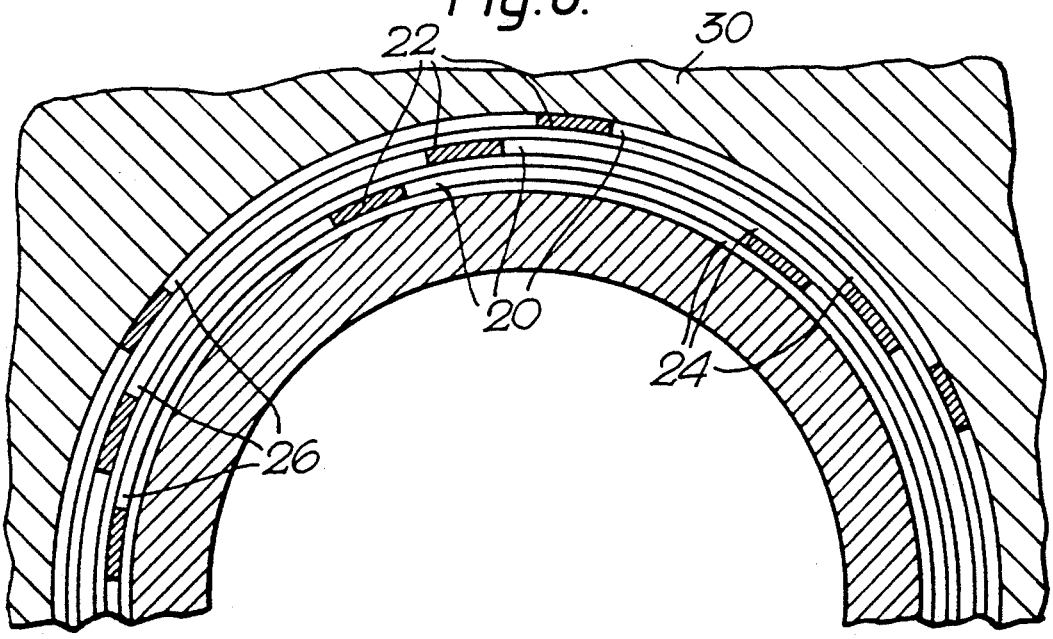
FIG. 6 is an alternative enlarged transverse cross-sectional view through the assembly in FIG. 3.

In FIG. 5 the separate pieces of metal matrix composite 20, and the separate pieces of unreinforced metal matrix 22 are secured to a continuous backing strip 24 to allow the separate pieces of metal matrix composite 20 and unreinforced metal matrix 22 to be easily wound into a spiral. A ring formed from the backing strip 24, the pieces of metal matrix composite 20 and unreinforced metal matrix 22 is shown in FIG. 6. The backing strip 24 is a thin strip of unreinforced metal matrix which is consolidated into the final component structure. Alternatively the backing strip 24 may be a plastic, or other suitable material which may be subsequently burnt off when the spiral is in place between the inner and outer metal rings.

The ceramic fibers have for example diameters of the order of 140 microns and the metal matrix composite pieces have a thickness of for example of 0.01 inch=0.25 mm. When the laminates of metal matrix composite pieces are consolidated this gives a 35–45% volume fraction of ceramic fibers. The introduction of an unreinforced metal matrix backing strip reduces the volume fraction of ceramic fibers in the consolidated structure, therefore it is necessary for the backing strip to be relatively thin to minimize the reduction in volume fraction of ceramic fibers.

The pieces of metal matrix composite and the pieces of unreinforced metal matrix may alternatively be arranged in concentric laminations to form a ring in which the fibers extend circumferentially. The laminations, may comprise a single piece of metal matrix composite and a single piece of unreinforced metal matrix, or they may comprise a plurality of pieces of metal matrix and a plurality of pieces of unreinforced metal matrix.

The consolidation of the assembly of inner metal ring, laminations of metal matrix composite pieces and unreinforced metal matrix pieces and the outer metal ring may be by using an extra inner ring, or cylinder, of high expansion coefficient material and an extra outer ring, or cylinder, of low expansion coefficient material. The assembly is placed into a vacuum chamber, which is subsequently evacuated. The assembly is then consolidated using heat which causes the inner ring to expand more than the outer ring and thus consolidate the assembly to form a fibre reinforced metal ring. The edges of the inner and outer metal rings of the composite assembly may be electron beam welded together.

Figure 7:
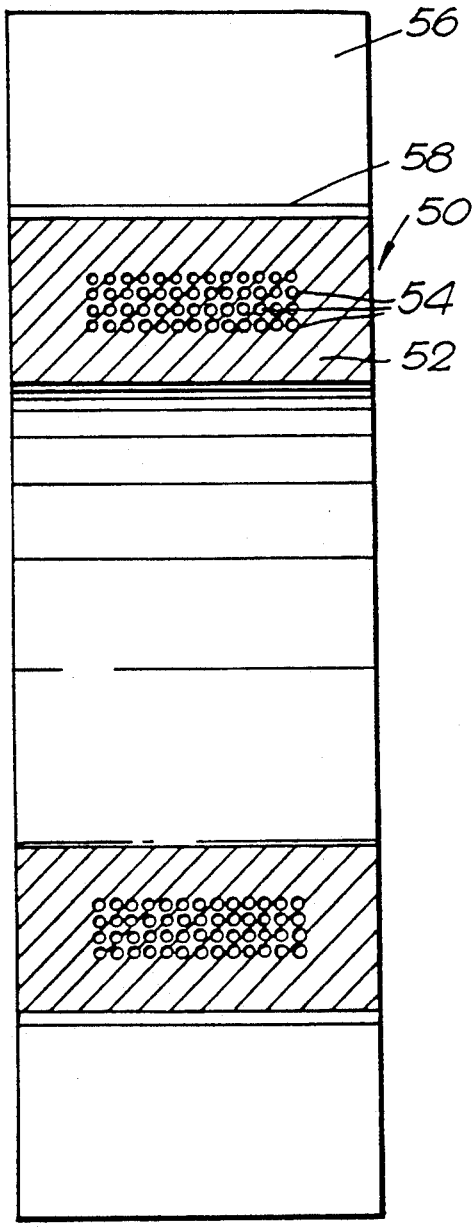
FIG. 7 is a longitudinal cross-sectional view through an alternative bladed compressor rotor made according to the present invention.

A further finished ceramic fibre reinforced metal rotor 50 with rotor blades is shown in FIG. 7. The rotor comprises a metal ring 52 which includes a ring of circumferentially extending reinforcing ceramic fibers 54, which are fully diffusion bonded into the metal ring 52. A plurality of solid metal rotor blades 56, extend radially outwardly from the metal ring 52. The rotor blades 56 are secured to the metal ring 52 by welds 58.

The pieces of metal matrix composite 20 and the pieces of unreinforced metal matrix 22 are arranged in a spiral by placing the pieces alternately adjacent each other in end to end relationship on the inner surface of the outer metal ring 64. The outer metal ring 64 has two radially inwardly extending flanges 63 and 65 at opposite axial ends which locate the pieces axially. When the pieces of metal matrix composite and pieces of unreinforced metal matrix have been arranged in laminations to the internal diameter of the flanges 63 and 65, the inner metal ring 62 is pushed coaxially into the outer metal ring 64.

Figure 8:
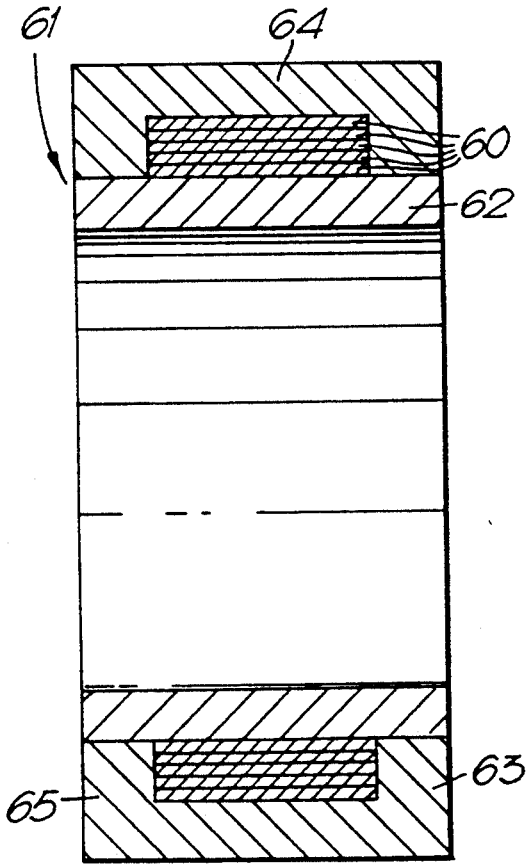
FIG. 8 is a longitudinal cross-sectional view through an assembly of strips of unidirectional fibre reinforced metal matrix and inserts of unreinforced metal matrix positioned between inner and outer metal rings.

The bladed rotor 50 is produced in a similar manner to that in FIG. 1, but the outer metal ring 64 has a much smaller radial dimension in FIG. 8 than that in FIG. 3. Therefore after the assembly has been consolidated, instead of electrochemically machining the outer metal ring 64 to produce the integral rotor blades, a plurality of solid metal rotor blades are electron beam welded or friction welded onto the outer metal ring 64.

The pieces of metal matrix composite and the pieces of unreinforced metal matrix may be arranged between two radially outwardly extending flanges on the inner metal ring, and the outer metal ring may be pushed coaxially onto the inner metal ring. Other suitable methods of locating the pieces between the inner and outer metal rings may be used.

The consolidation process uses intense heat and pressure, and is usually a hot isostatic pressing process. Pressures of greater than 5,000 lbs per square inch, for example 15,000 lbs per square inch, and temperatures in the range of 850° C. to 930° C., for example 900° C. for titanium alloy, are used depending on the matrix material.

A suitable continuous metal matrix strip of silicon carbide fibers in a titanium - 6 aluminum - 4 vanadium alloy metal matrix. The metal matrix strip, or suitable silicon carbide fibers, for example S6S-6 fibers, are obtainable from Textron.

It is necessary to determine where the stresses are relative to the metal matrix composite pieces. Each piece of unreinforced metal matrix is placed in the strongest part of the component. In the case of components which are blade carrying rings/rotors it is necessary to place the pieces of unreinforced metal matrix in a particular relationship to the blades. It is possible to take advantage of the stress distribution in the ring/rotor to ensure that there are no problems caused by the reduction in the number of load bearing fibers. Each piece of unreinforced metal matrix is placed in the strongest part of the ring/rotor relative to the blades, that is, the pieces of unreinforced metal matrix are placed in the regions of the ring/rotor which have the lowest stress. The stress distribution in a blade carrying ring/rotor has a sinusoidal form in a circumferential direction, and the pieces of unreinforced metal matrix are located at the regions of the ring/rotor which correspond to the lowest stressed regions of the ring/rotor.

The particular locations of the pieces of unreinforced metal matrix depends on the particular arrangement of the ring/rotor, the particular blade shapes and the particular attachment features between the blades and the ring/rotor. It is important to ensure that the pieces of unreinforced metal matrix in adjacent layers are not radially aligned.

For example a bladed rotor was made using an outer metal ring, which has an inner diameter of 100 mm and an outer diameter of 170 mm an inner metal ring which has an inner diameter of 85 mm an outer diameter of 94 mm. The inner and outer metal rings had a width of 35 mm. The pieces of silicon carbide fibre reinforced titanium matrix composite and the pieces of unreinforced titanium matrix had a thickness of 0.27 mm and a width of 15 mm. The pieces of silicon carbide fibre reinforced titanium matrix composite and the pieces of unreinforced titanium matrix were arranged in adjacent abutting relationship to form twelve layers between the inner and outer metal rings. The pieces of unreinforced titanium matrix had lengths corresponding to an arc of 10°-20° and the pieces of silicon fibre reinforced titanium matrix composite had lengths corresponding approximately to an arc of 320° to 360°.

Figure 9:
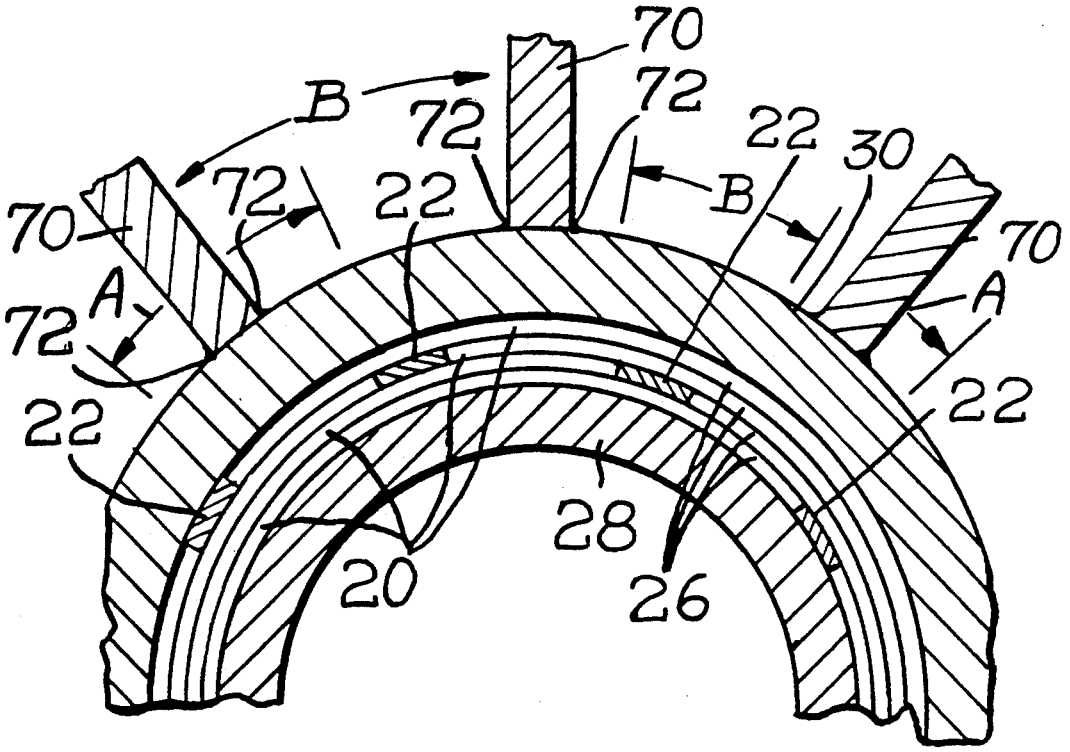
FIG. 9 is a view similar to FIG. 7 showing another view of the arrangement of the blades in the present invention.

As shown in FIG. 9, there is illustrated an example of the relative positions of the blades and the unreinforced metal matrix pieces. The regions "A" of the rotor immediately adjacent to a blade 70 are highly stressed in use as they must withstand the radial loads and stresses due to the blade when the rotor is rotated at high speeds as well as the hoop stresses. The regions "B" of the rotor at positions substantially between the adjacent blade 70 are not as highly stressed as they only must withstand the hoop stresses. In this embodiment, the unreinforced metal matrix pieces 22 are placed in the regions "B" where only the hoop stresses act. The best place for an unreinforced metal matix piece 22 would be at a position equidistant from both of two adjacent blades 70. The unreinforced metal matrix pieces 22 are positioned in regions "B" outside of the regions "A" having high stresses produced by the fillet radii 72 of the blade 70.

The inner and outer metal rings may be titanium, titanium aluminide, any titanium alloy or any other metal, intermetallic or alloy which is capable of being bonded together. The metal matrix composite may be a matrix of titanium, aluminum, nickel or magnesium metal or alloy. The metal matrix composite may be reinforced with silicon carbide, silicon nitride, boron, alumina or other suitable ceramic fibers.

The consolidated fibre reinforced metal ring may be a finished or semi-finished component. The consolidated fibre reinforced metal ring may be a finished cylinder, casing or shaft. The consolidated fibre reinforced metal ring may be a semi-finished rotor.

What is claimed is:

1. A method of manufacturing a member having a body and an axis of rotation with the body adapted to rotate in use about said axis of rotation, said method comprising the steps of:

arranging at least one piece of metal matrix composite and at least one piece of unreinforced metal matrix alternately in adjacent abutting relationship to form at least one annular laminate, the at least one piece of metal matrix composite having a plurality of unidirectionally arranged fibers in a metal matrix and the fibers of the at least one piece of metal matrix composite extending in substantially the same direction;

arranging the at least one annular laminate in a first annular metal member and a second annular metal member to form an assembly; and consolidating the assembly to bond the first annular member, the at least one annular laminate, and the second annular metal member to form a unitary composite component, attaching to the outer most one of said first and second annular metal members blade means spaced circumferentially about said axis of rotation, each said blade means being attached to said associated annular metal member whereby at least one composite piece of unreinforced metal matrix is at a position between two adjacent blades where radial stresses due to the blades are minimal.

2. The method as claimed in claim 1 including the step of arranging the at least one piece of unreinforced metal matrix and the blades relatively such that the at least one piece of unreinforced metal matrix is at a position equidistant from two adjacent blades.

3. A method as claimed in claim 1 in which a plurality of separate pieces of metal matrix composite and a plurality of pieces of unreinforced metal matrix are arranged to form at least one laminate.

4. A method as claimed in claim 1 in which the at least one separate piece of metal matrix composite and the at least one piece of unreinforced metal matrix are arranged in a ring, the first metal member and the second metal member are rings.

5. A method as claimed in claim 3 in which a plurality of separate pieces of metal matrix composite and a plurality of pieces of unreinforced metal matrix are arranged in a spiral to form a plurality of laminates.

6. A method as claimed in claim 3 in which a plurality of separate pieces of metal matrix composite and a plurality of pieces of unreinforced metal matrix are arranged in concentric rings to form a plurality of laminates.

7. A method as claimed in claim 1 in which the pieces of metal matrix composite have equal lengths.

8. A method as claimed in claim 3 in which the second metal ring is positioned radially outwardly of the at least one laminate of metal matrix composite.

9. A method as claimed in claim 8 comprising welding at least one rotor blade onto the second metal ring.

10. A method as claimed in claim 9 in which the at least one rotor blade is welded onto the second metal ring by friction welding or electron beam welding.

11. A method as claimed in claim 8 comprising machining the second metal ring to form at least one rotor blade integral with the second metal ring.

12. A method as claimed in claim 11 in which the second metal ring is electrochemically machined to form the at least one rotor blade.

13. A method as claimed in claim 3 in which the separate pieces of metal matrix composite and the pieces of unreinforced metal matrix are secured to a continuous backing strip to allow the separate pieces of metal matrix composite and the pieces of unreinforced metal matrix to be wound into a spiral.

14. A method as claimed in claim 13 in which the backing strip comprises unreinforced metal matrix.

15. A method as claimed in claim 13 in which the backing strip comprises a plastic or other suitable material which is subsequently removed.

16. A method as claimed in claim 1 in which the first metal member and the second metal member comprise titanium, titanium aluminide, an alloy of titanium or any suitable metal, alloy or intermetallic which is capable of being bonded.

17. A method as claimed in claim 1 in which the metal matrix composite comprises a matrix of titanium, titanium aluminide, an alloy of titanium or any suitable metal, alloy or intermetallic which is capable of being bonded.

18. A method as claimed in claim 1 in which the fibers comprise silicon carbide, silicon nitride, boron, alumina or other suitable ceramic fibers.

19. A method as claimed in claim 1 in which the consolidating process comprises hot isostatic pressing.

20. A method as claimed in claim 1 in which the consolidating process comprises differential hot expansion of a first ring inside a suitable low expansion second ring.

21. A method as claimed in claim 8 in which the pieces of metal matrix composite and the pieces of metal matrix are arranged on the inner surface of the second metal ring, the first metal ring is moved coaxially into the second metal ring.

22. A method as claimed in claim 21 in which the second metal ring has a radially inwardly extending flange at one axial end to locate the pieces of metal matrix composite and the pieces of metal matrix axially.

23. A method as claimed in claim 21 in which the first metal ring has a radially outwardly extending flange at one axial end to locate the pieces of metal matrix composite and the pieces of metal matrix axially.

* * * * *